US011095072B2

(12) United States Patent
Watkins et al.

(10) Patent No.: US 11,095,072 B2
(45) Date of Patent: Aug. 17, 2021

(54) COAXIAL CONNECTOR HAVING TORQUE-LIMITING COMPRESSION RING

(71) Applicant: PPC BROADBAND, INC., East Syracuse, NY (US)

(72) Inventors: Harold J. Watkins, Chittenango, NY (US); Richard Maroney, Camillus, NY (US); Steve Stankovski, Clay, NY (US); Chris Shyne, Manlius, NY (US); Amos McKinnon, Liverpool, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/443,856

(22) Filed: Jun. 17, 2019

(65) Prior Publication Data

US 2019/0386426 A1 Dec. 19, 2019

Related U.S. Application Data

(60) Provisional application No. 62/685,908, filed on Jun. 15, 2018.

(51) Int. Cl.
*H01R 13/622* (2006.01)
*H01R 13/52* (2006.01)

(52) U.S. Cl.
CPC ..... *H01R 13/622* (2013.01); *H01R 13/5202* (2013.01); *H01R 13/5219* (2013.01)

(58) Field of Classification Search
CPC ..... H01R 13/622; H01R 13/5219; H01R 13/5202
See application file for complete search history.

(56) References Cited

U.S. PATENT DOCUMENTS 4,575,274 A 3/1986 Hayward
6,042,422 A * 3/2000 Youtsey ..... H01R 9/0518 439/585
7,544,094 B1 * 6/2009 Paglia ..... H01R 9/0518 439/585
8,568,167 B2 * 10/2013 Montena ..... H01R 9/0524 439/578
8,591,244 B2 * 11/2013 Thomas ..... H01R 9/0524 439/321

(Continued)

OTHER PUBLICATIONS

Search Report dated Sep. 10, 2019 in corresponding International Application No. PCT/US19/37560, 2 pages.

(Continued)

*Primary Examiner* — Briggitte R. Hammond
(74) *Attorney, Agent, or Firm* — MH2 Technology Law Group LLP

(57) ABSTRACT

A connector is provided for attachment to a coaxial cable. The connector includes, in one embodiment, a body and a compression ring. The body has a cable receiving end being configured to receive the end of the coaxial cable. The compression ring includes a forward sleeve portion and a rearward outer ring portion attached to one another by a plurality of tabs. The forward sleeve portion is configured to couple to the cable receiving end of the body. The plurality of tabs are configured to shear so as to separate the rearward outer ring portion from the forward sleeve portion when a torque for rotating the compression ring relative to the body exceeds a desired torque.

21 Claims, 7 Drawing Sheets

(56) References Cited

U.S. PATENT DOCUMENTS

| | | | | |
|---|---|---|---|---|
| 9,564,695 | B2 * | 2/2017 | Hammons | H01R 9/0524 |
| 9,929,498 | B2 * | 3/2018 | Thakare | H01R 13/622 |
| 9,929,499 | B2 * | 3/2018 | Thakare | H01R 13/622 |
| 2010/0081322 | A1 | 4/2010 | Malloy et al. | |
| 2013/0029513 | A1 | 1/2013 | Montena | |
| 2015/0118901 | A1 | 4/2015 | Burris | |

OTHER PUBLICATIONS

Written Opinion dated Sep. 10, 2019 in corresponding International Application No. PCT/US19/37560, 6 pages.
International Preliminary Report on Patentability dated Dec. 15, 2020 in corresponding International Application No. PCT/US19/37560, 7 pages.

* cited by examiner

COAXIAL CONNECTOR HAVING TORQUE-LIMITING COMPRESSION RING

CROSS-REFERENCE TO RELATED APPLICATION

This nonprovisional application claims the benefit of U.S. Provisional Application No. 62/685,908, filed Jun. 15, 2018. The disclosure of the prior application is hereby incorporated by reference herein in its entirety.

TECHNICAL FIELD

The present disclosure relates generally to connectors for terminating coaxial cable. More particularly, the present disclosure relates to a coaxial cable connector having a torque-limiting compression ring that does not require a compression tool for installation.

BACKGROUND

It has long been known to use connectors to terminate coaxial cable so as to connect a cable to various electronic devices such as televisions, radios and the like. Conventional coaxial cables typically include a center conductor surrounded by an insulator. A braided or foil conductive shield is disposed over the insulator. An outer insulative jacket surrounds the shield. In order to prepare the coaxial cable for termination, the outer jacket is stripped back exposing an extent of the conductive shield which is folded back over the jacket. A portion of the insulator extends outwardly from the jacket and an extent of the center conductor extends outwardly from insulator. Such a prepared cable may be terminated in a conventional coaxial connector.

Coaxial connectors of this type include a connector body having an inner cylindrical post which is inserted between the insulator and the conductive shield. A compression ring is provided to secure the cable within the body of the coaxial connector. The compression ring, which is typically formed of a resilient plastic, is securable to the connector body to secure the coaxial connector thereto. Conventional connectors of this type require a compression tool for installation. Thus, installers need to carry these compression tools into the field and, if the compression tool breaks or is misplaced, the conventional connectors cannot be assembled to a coaxial cable.

Additionally, some conventional compression tools may not be configured to ensure that the compression ring provides a desired amount of compression to the coaxial cable. For example, use of such conventional compression tools may result in a connector that is assembled to a coaxial cable with insufficient compression, which could lead to the connector becoming loosened from the cable, thus resulting in a degraded signal or signal loss. On the other hand, use of such conventional compression tools may result in a connector that is assembled to a coaxial cable with too much compression, which could damage the cable, thus resulting in a degraded signal or signal loss.

Therefore, is may be desirable to provide a coaxial connector that can be assembled to a coaxial cable without the use of a compression tool. Further, it may be desirable to provide a coaxial connector that can be assembled to a coaxial cable with a desired amount of compression.

SUMMARY

According to some aspects of the disclosure a coaxial cable connector is provided for terminating a coaxial cable.

In various aspects, a coaxial cable connector has a body and a compression ring, wherein the compression ring secures the cable within the connector body.

In accordance with some embodiments, the body has a cable receiving end configured to receive the end of the coaxial cable. The compression ring includes a forward sleeve portion and a rearward outer ring portion attached to one another by a plurality of tabs. The forward sleeve portion is configured to couple to the cable receiving end of the body. The plurality of tabs are configured to shear so as to separate the rearward outer ring portion from the forward sleeve portion when a torque for rotating the compression ring relative to the body exceeds a desired torque.

In a method aspect, the present disclosure provides for the termination of a coaxial connector with the connector. The method provides for the optional detaching of a compression ring from a connector body. The compression ring is then positioned over the cable. The cable is then inserted into the end of the connector body. The compression ring is then reattached to the end of the connector body and rotated relative to the connector body to secure the cable thereto. The plurality of tabs are configured to shear so as to separate the rearward outer ring portion from the forward sleeve portion when a torque for rotating the compression ring relative to the body exceeds a desired torque.

DETAILED DESCRIPTION OF EMBODIMENTS

Figure 1:
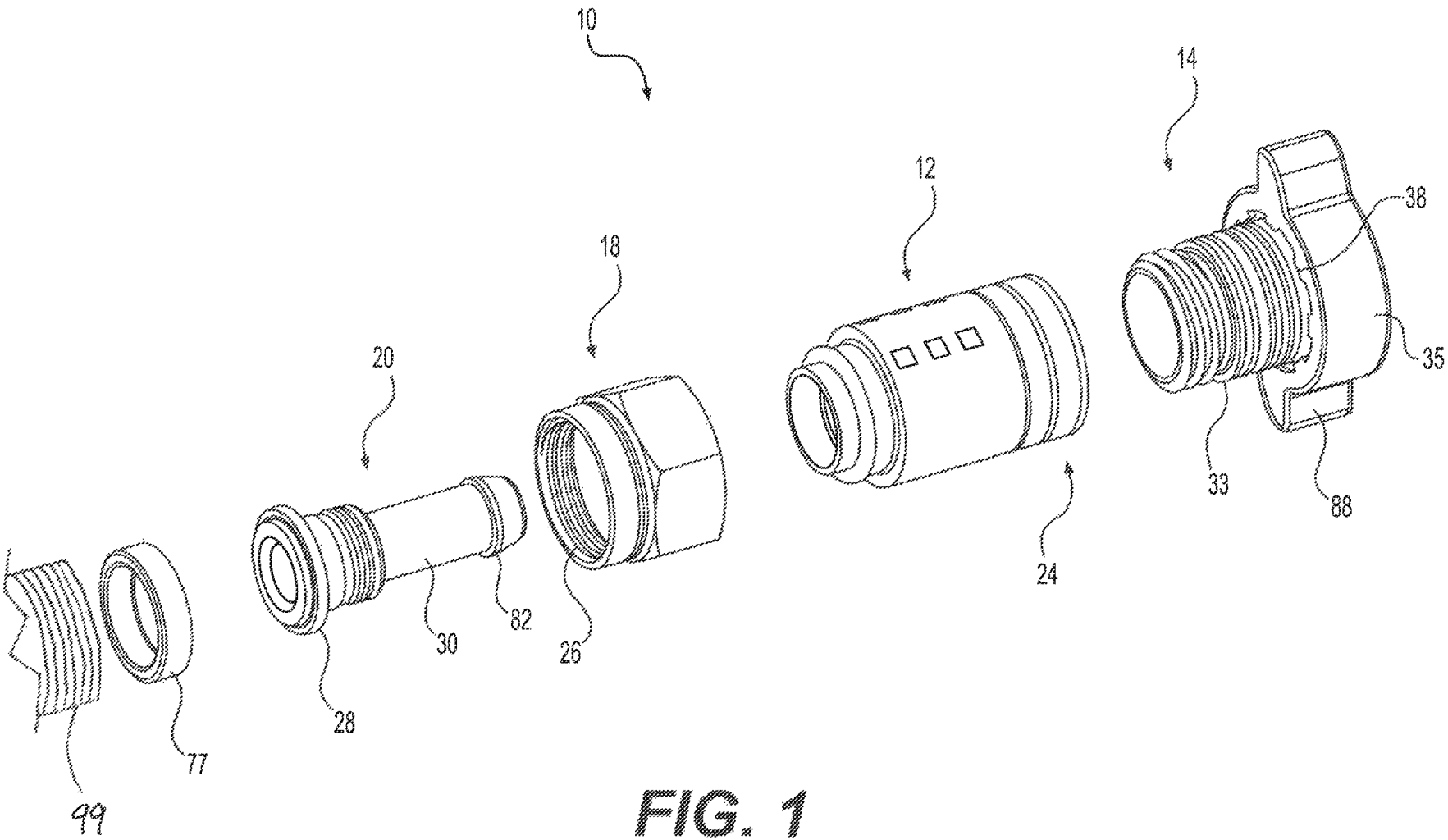
FIG. 1 is an exploded perspective view of an exemplary coaxial connector in accordance with various aspects of the present disclosure.

FIGS. 1-6 illustrate an exemplary coaxial cable connector 10 in accordance with various aspects of the present disclosure. The connector 10 includes a body 12, a torque-limiting compression ring 14, a coupler 18 such as an annular nut, and an outer conductor engager or annular post 20. The body 12 is an elongate, generally cylindrical conductive member, which may be made, for example, of a metal such as, but not limited to, brass. The body 12 includes a rearward portion 16 for accommodating a coaxial cable and a forward portion 15 for coupling with the post 20.

The post 20 couples the forward portion 15 of the body 12 with the coupler 18 such that the coupler 18 is rotatably coupled to the body 12 and the post 20 to provide mechanical attachment of the connector 10 to an interface port 99 of an external device. For example, the post 20 may include a rearward-facing shoulder 21 that cooperates with a forward-facing shoulder 19 of the coupler 18 to provide the rotatable coupling. A resilient sealing O-ring 22 may be positioned between the body 12 and the coupler 20 at the rotatable juncture thereof to provide a seal thereat. A sealing gasket 77 may be disposed at the forward end of the post 20 to provide a weather tight seal between the coupler 18, the post 20, and the interface port.

The rearward portion 16 of the body 12 includes a cable receiving end 24 for insertably receiving an inserted coaxial cable. The coupler 18 includes an internally threaded end 26 permitting screw threaded attachment of the connector 10 to the interface port 99 of an external device. The cable receiving end 24 is at a rearward end of the rearward portion 16 of the body 12, and the internally threaded end 26 is at a forward end of the coupler 18.

The post 20 includes a base portion 28 which provides for securement of the coupler 18 between the body 12 and the post 20 and an annular tubular extension 30 extending rearward from the base portion 28 into the body 12. Also, an inner surface 40 of the forward portion 15 of the body 12 may include a retention structure 42, for example, a radial inward protrusion, that is mechanically coupled with a retention structure 52, for example, a notch of the outer surface 50 of the annular tubular extension 30 of the post 20. The retention structures 42, 52 may extend about the entire circumference or a portion of the circumference of the body and the tubular extension, respectively. It should be appreciated that the retention structures 42, 52 may be reversed in some embodiments such that retention structure 42 is a notch and retention structure 52 is a protrusion. As will be described in further detail hereinbelow and as is conventionally known, the extension 30 of the post 20 and the rearward portion 16 of the body 12 define an annular opening 32 for accommodating the jacket and shield of the inserted coaxial cable.

The torque-limiting compression ring 14 includes a generally cylindrical forward sleeve portion 33 and a rearward outer ring portion 35. The rearward outer ring portion 35 is attached to the forward sleeve portion 33 by a plurality of tabs or fingers 38 that taper in the radially inward direction. The outer ring portion 35 may include one or more torque assisting structures 88. The compression ring 14 is formed of a material selected such that the plurality of tabs 38 will shear when a desired torque is met during installation, as described in more detail below. In some aspects, each of the tabs 38 may include a strengthening member 39 at its radially outer portion 60. The tapering of the tabs 38 and the strengthening members 39 facilitate breakage of the tabs 38 at a radially inner portion 62 of the tabs 38 that connects to the forward sleeve portion 33. Also, the body 12 includes a first stop 17 at the rearward end of the rearward portion 16 and a second stop 19 formed by a shoulder extending radially inward from an inner surface 13 of the rearward portion 12. The first and second stops 17, 19 prevent the compression ring 14 from being overtightened to the body 12.

The forward sleeve portion 33 has a flared rearward end 34 through which a cable may be inserted and an opposite forward end 36 which is insertable into the cable receiving end 24 of the body 12. An outer surface 64 of the forward end 36 of the compression ring 14 includes a threaded portion 66 that is threadedly coupled with a threaded portion 68 of the inner surface 13 of the rearward portion 16 of the body 12. The threaded portions 66, 68 allow for detachable, re-attachable connection of the compression ring 14 to the body 12. Furthermore, as the compression ring 14 is rotated clockwise relative to the body 12, the compression ring 14 is axially moved along a direction of arrow A of FIG. 2, towards the coupler 18 from a first position shown in FIGS. 2 and 4, which loosely retains the coaxial cable within the body 12 to a more forward second position shown in FIG. 3, which secures the cable within the body 12.

Figure 4:
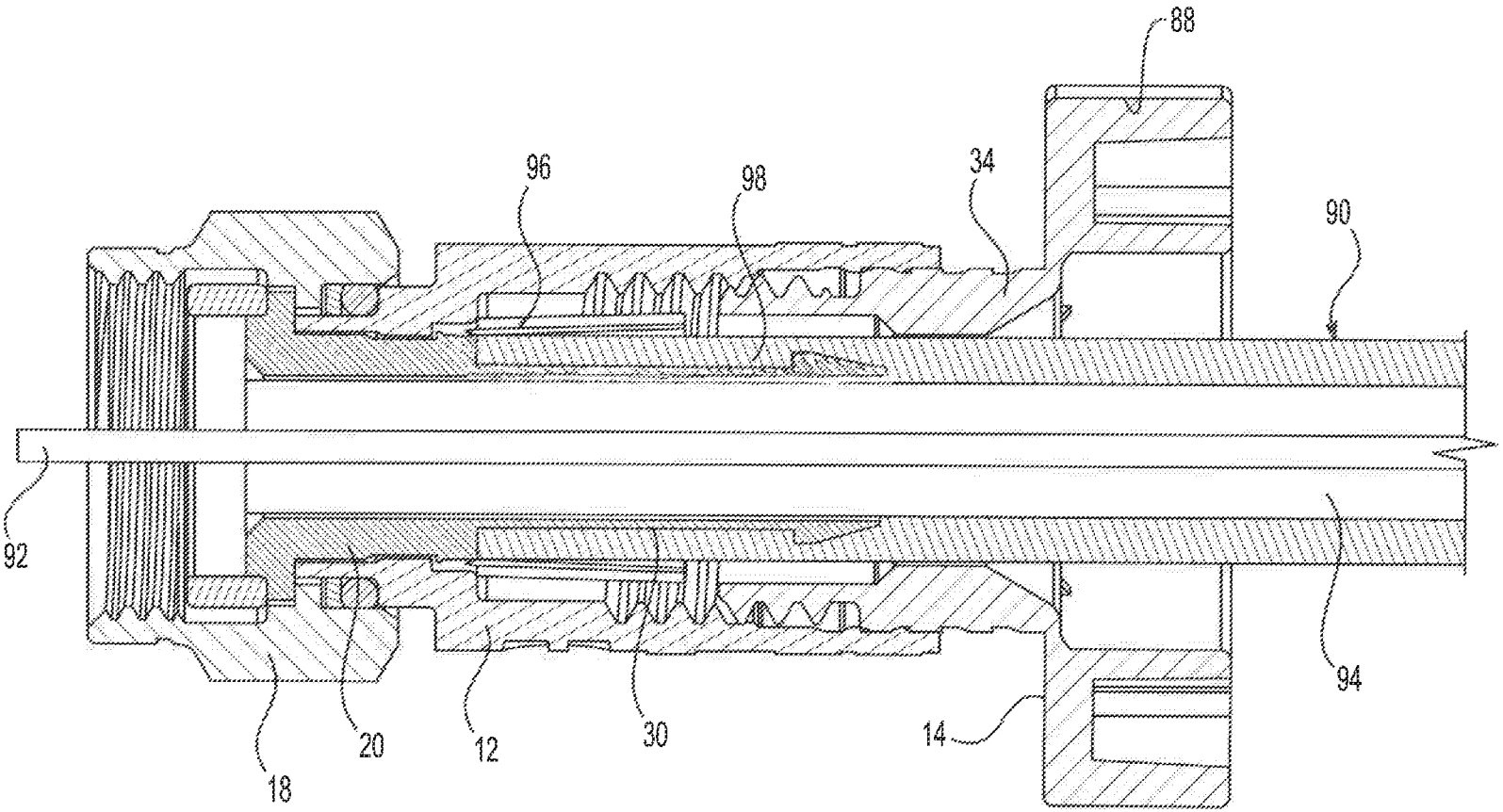
FIG. 4 is a side cross-sectional view of the exemplary coaxial connector of FIG. 1 with a coaxial cable.
Figure 5:
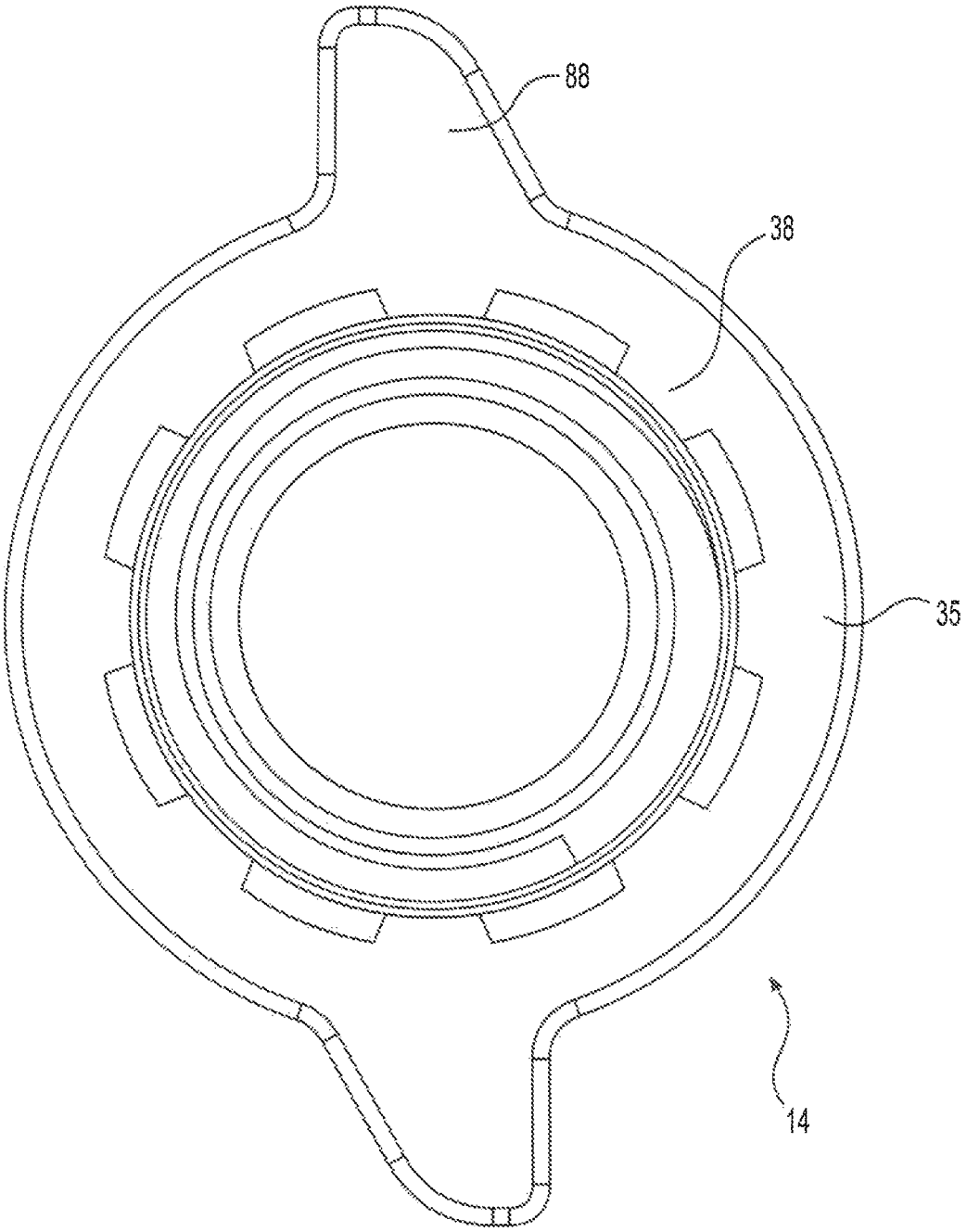
FIG. 5 is a front view of the exemplary coaxial connector of FIG. 1.
Figure 6:
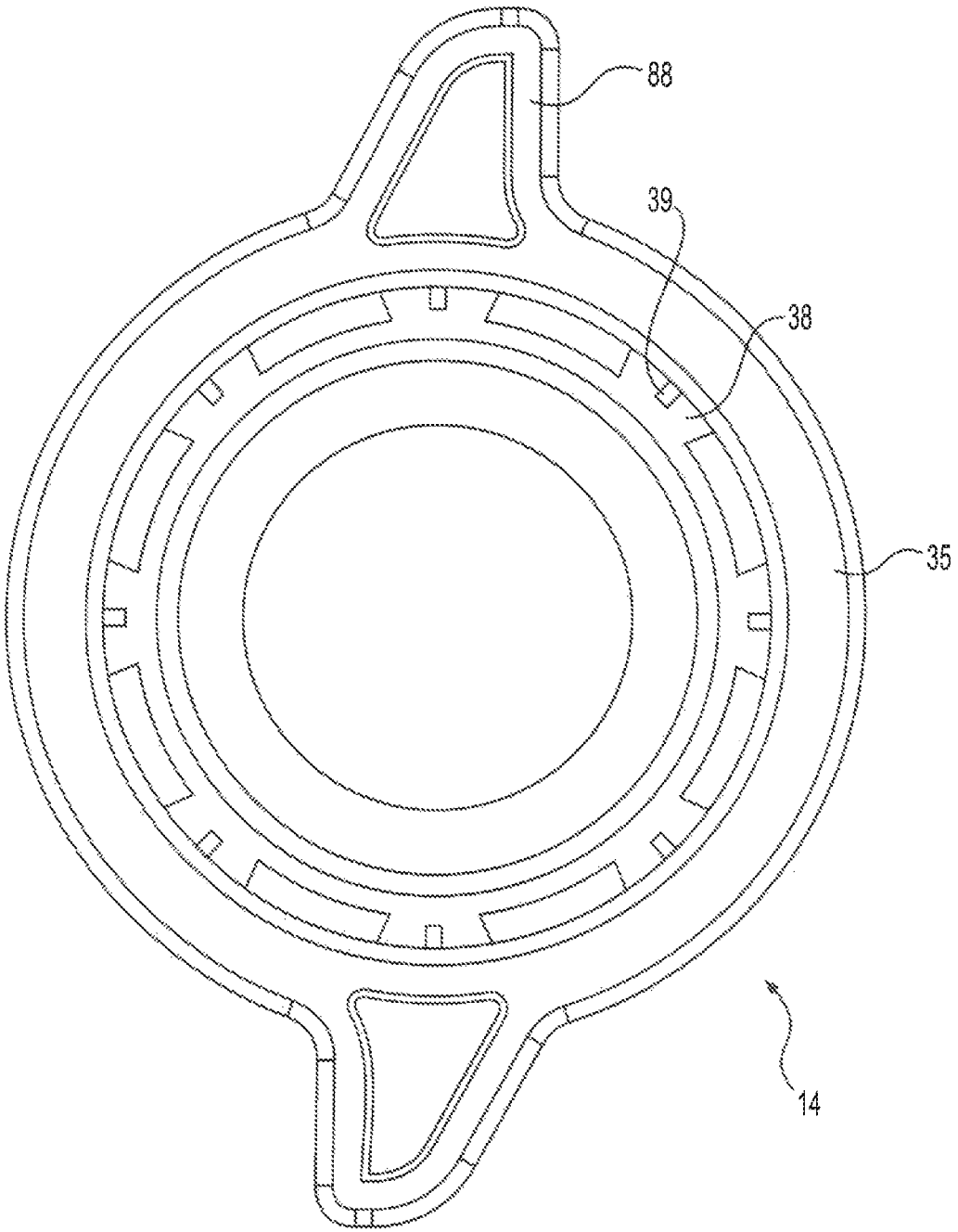
FIG. 6 is a rear view of the exemplary coaxial connector of FIG. 1.
Figure 7:
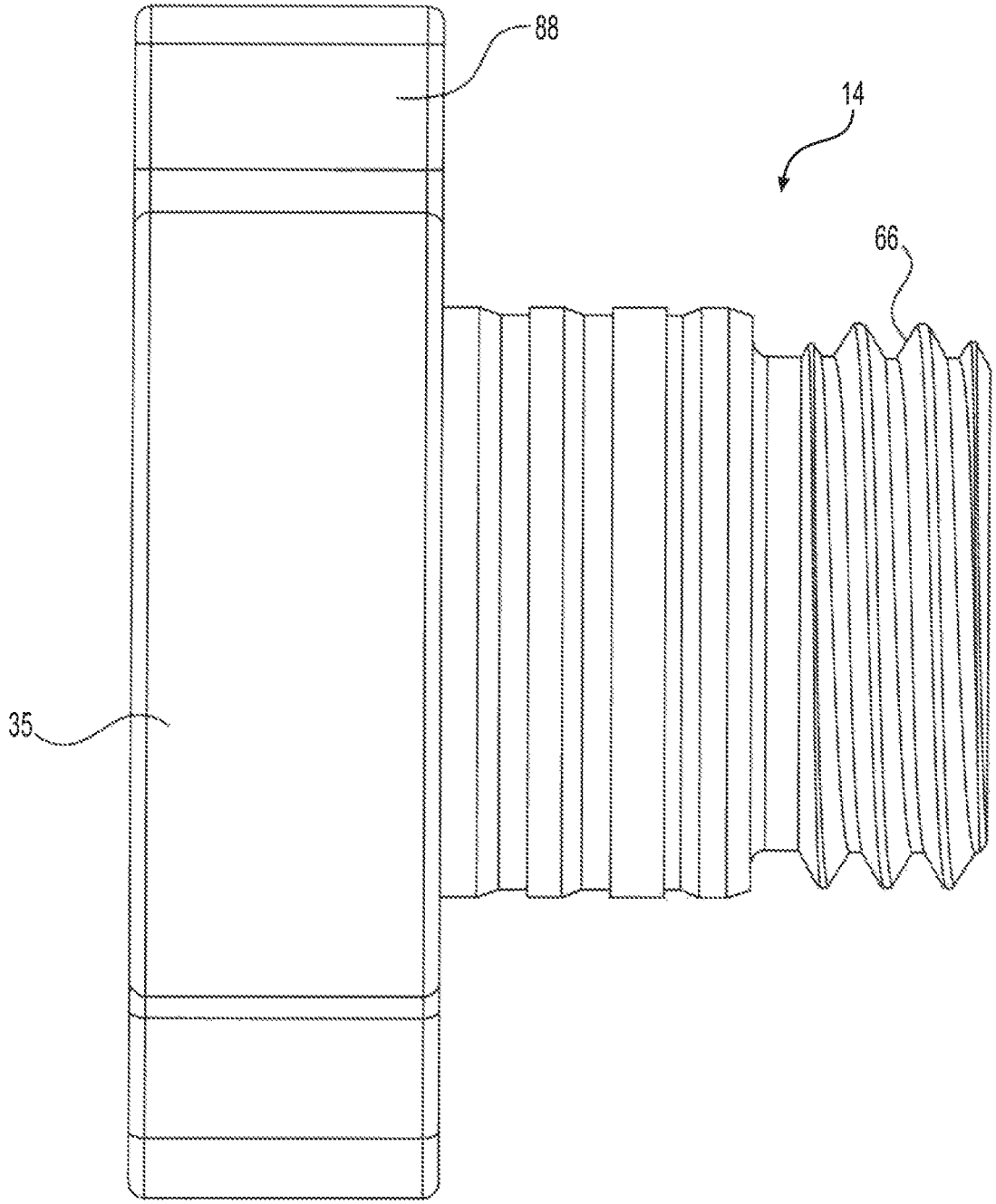
FIG. 7 is a side view of the compression ring of the exemplary coaxial connector of FIG. 1.

Having described the components of connector 10 in detail, the use of connector 10 in terminating a coaxial cable may now be described with respect to FIG. 4. The coaxial cable 90 includes an elongate inner conductor 92 formed of copper or similar conductive material. Extending around the inner conductor 92 is a conductor insulator 94 formed of a suitably insulative plastic. A metallic shield 96 is positioned in surrounding relationship around the insulator 94. In some aspects, the shield 96 is a metallic braid, however, other conductive materials such as metallic foil may also be employed. Covering the shield 96 is an outer insulative jacket 98.

Figure 2:
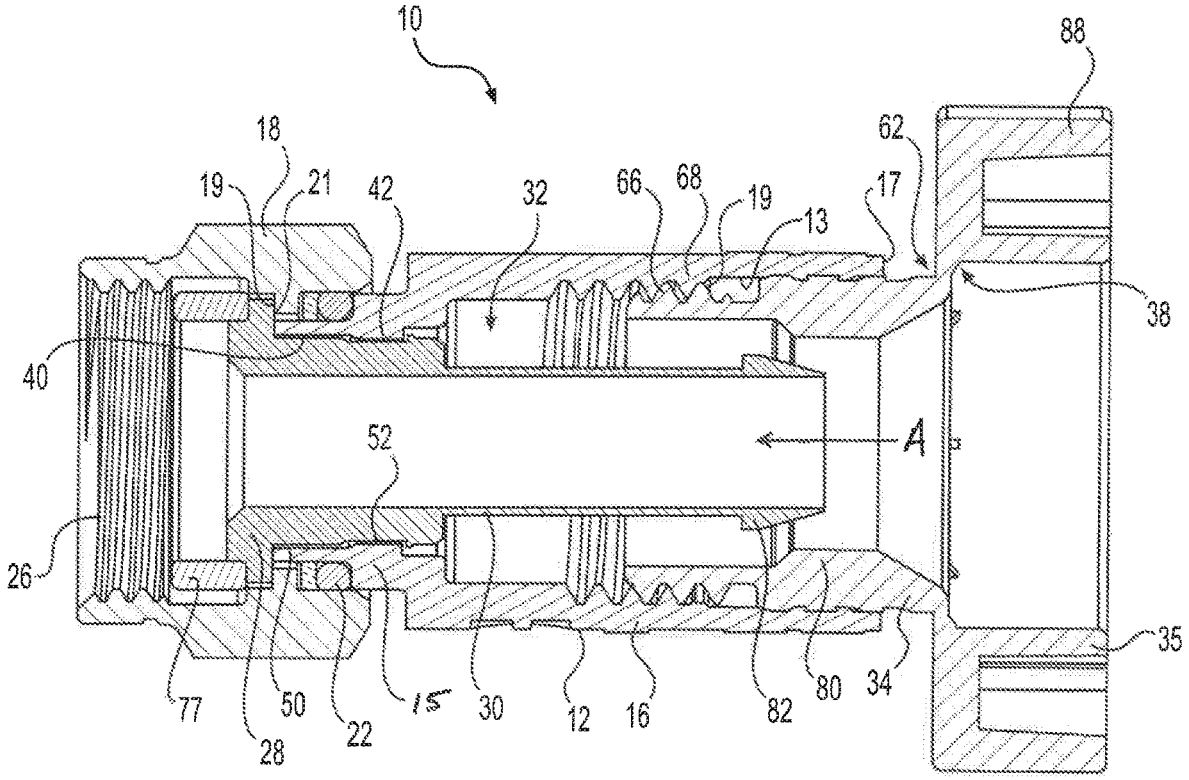
FIG. 2 is a side cross-sectional view of the exemplary coaxial connector of FIG. 1.

Cable 90 is prepared in conventional fashion for termination, by stripping back the jacket 98 exposing an extent of the shield 96. A portion of insulator 94 extends therefrom with an extent of the conductor 92 extending from the insulator 94. The preparation process includes folding back an end extent of the shield 96 about the jacket 98. As shown in exploded view in FIG. 4, the cable 90 may be inserted into the connector 10 with the compression ring 14 coupled to the body 12 as shown in FIGS. 2 and 4. In this technique, the prepared cable 90 is inserted through the outer ring portion 35, through the rearward end 34 of the forward sleeve portion 33, and into the receiving end 24 of the body 12. The extension 30 of the post 20 is inserted between the insulator 94 in the metallic shield 96 such that the shield 96 and the jacket 98 reside within the annular region 32 defined between the post 20 and the rearward portion 16 of the body 12. In this position, the compression ring 14 is coupled to body in the first position shown in FIGS. 2 and 4. In such first position, sufficient clearance is provided between the compression ring 14 and the post 20 so that the extension 30 may easily be interposed between the insulator 94 and the shield 96.

Once the cable 60 is properly inserted, the threaded portion 66 of the compression ring 14 is threadedly coupled with the threaded portion 68 of the body 12, and the compression ring 14 is rotated clockwise relative to the body 12 such that the compression ring 14 moves axially in the direction of arrow A toward the coupler 18. When a radially-inward protruding portion 80 of the forward sleeve portion 33 of the compression ring 14 moves axially over a barbed portion 82 at a rearward end of the extension 30 of the post 20, the forward sleeve portion 33 compresses the folded back metallic shield 96 and jacket 98 of the cable 90 against the extension 30 of the post 20. As a result of this compression, the torque required to continue rotation of the compression ring 14 relative to the body 12 increases. When the desired installation torque is reached, the material of the tabs 38, the tapering of the tabs 38, and/or the strengthening members 39 facilitate breakage of the tabs 38 at the radially inner portion 62 of the tabs 38 that connects to the forward sleeve portion 33 as further torque is applied to the outer ring portion 35 of the compression ring 14. The further torque will cause the tabs 38 to shear such that the outer ring portion 35 becomes separated from the forward sleeve portion 33. The outer ring portion 35 can then be moved rearward along the cable 90 in a direction away from the coupler 18 (opposite to arrow A). At this point, the installer can couple a tightening tool to the connector 10 to tighten the coupler 18 to an interface port.

Figure 8:
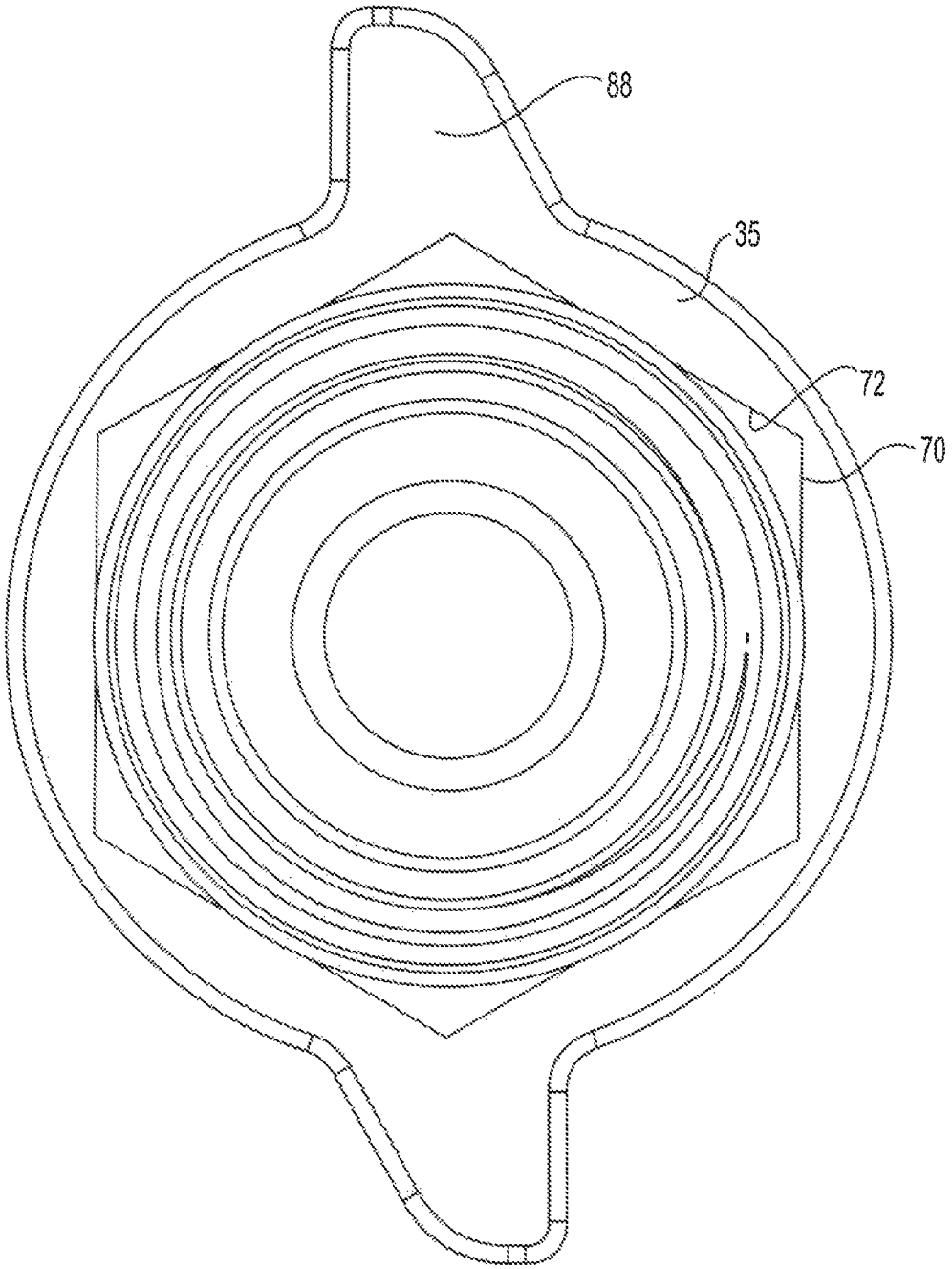
FIG. 8 is front view of another exemplary coaxial connector in accordance with various aspects of the present disclosure.

In some aspects, as shown in FIG. 8, the outer ring portion 35 and tabs of the compression ring 14 may be structured and arranged such that when the tabs shear to separate the outer ring portion 35 from the forward sleeve portion, the resultant opening 70 is sized to fit over the connector body 12 and onto the coupler 18. For example, the inner surface 72 of the sheared-off outer ring portion 35 may have a hexagonal shape that is complementary to the shape of the coupler 18 so that the outer ring portion 35 can be used to tighten the coupler 18 to an interface port.

Figure 3:
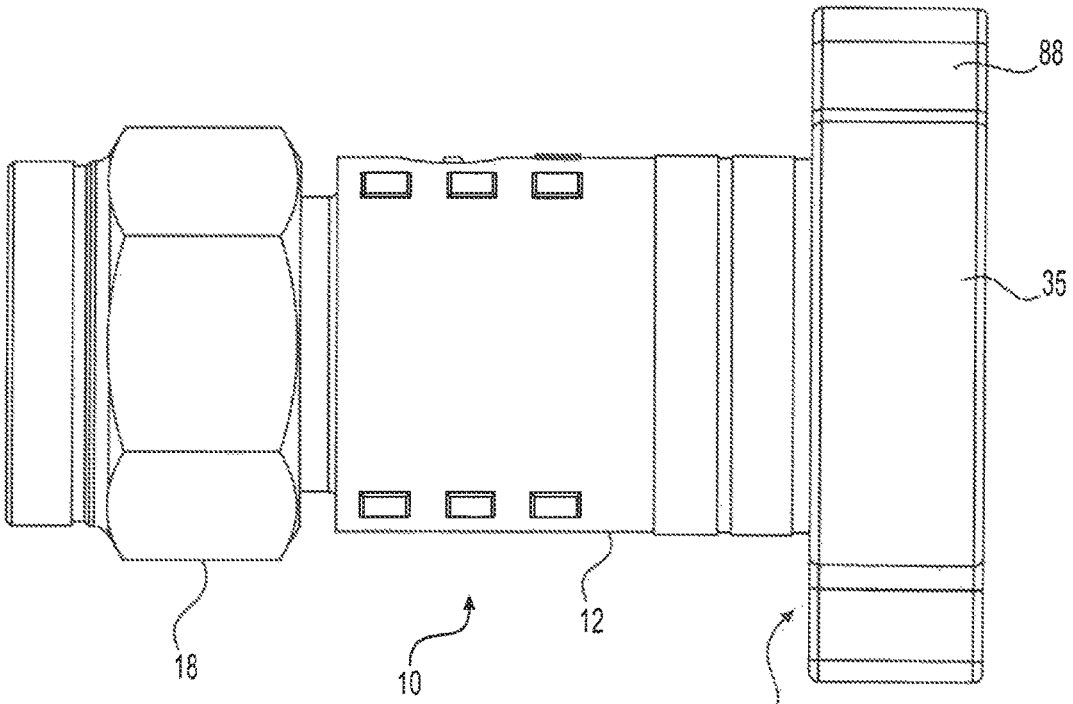
FIG. 3 is a side view of the exemplary coaxial connector of FIG. 1.

As described above, in some aspects, the connector 10 of the present disclosure may be constructed so as to be supplied in the assembled condition shown in FIGS. 1 and 3. In such assembled condition, and as will be described in further detail hereinbelow, a coaxial cable may be inserted through the rearward end 34 of the forward sleeve portion of the compression ring 14 and into the body 12. The compression ring 14 may be moved from the first position loosely retaining the cable to the second position which is axially forward thereby locking the cable to the body 12. It is, however, contemplated that, in some aspects, the compression ring 14 may be detached from the body 12 and placed around the coaxial cable, so as to allow the coaxial cable to be inserted directly into the cable receiving end 24 of the body 12. Thereafter, the compression ring 14 which has been placed around the cable may be reattached to the cable receiving end 24 of the body 12 where it can be moved from the first position to the second position locking the cable to the connector body. The threaded portions 66, 68 mentioned above are employed to provide such detachment and reattachment of the compression ring 14 to the body 12.

Additional embodiments include any one of the embodiments described above, where one or more of its components, functionalities or structures is interchanged with, replaced by or augmented by one or more of the components, functionalities, or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial cable connector configured to be coupled with an interface port, the connector comprising:

a body;

a torque-limiting compression ring;

a coupler; and an outer conductor engager, wherein the body includes a rearward portion for accommodating a coaxial cable and a forward portion for coupling with the outer conductor engager, wherein the outer conductor engager is configured to couple the body with the coupler such that the coupler is rotatably coupled relative to the body and the outer conductor engager, wherein the torque-limiting compression ring includes a generally cylindrical forward sleeve portion and a rearward outer ring portion, the rearward outer ring portion being attached to the forward sleeve portion by a plurality of tabs that taper in a radially inward direction, wherein the torque-limiting compression ring is configured to be rotated relative to the body, and such relative rotation moves the torque-limiting compression ring axially relative to the body and compresses a cable between an inner surface of the torque-limiting compression ring and an outer surface of the outer conductor engager, and wherein the plurality of tabs are configured to shear when a desired torque is met as the torque-limiting compression ring is rotated relative to the body such that the outer ring portion becomes separated from the forward sleeve portion.

2. The coaxial cable connector of claim 1, wherein a material of the tabs, the tapering of the tabs, and/or strengthening members at a radially outer portion of the tabs facilitate breakage of the tabs at a radially inner portion of the tabs that connects to the forward sleeve portion.

3. A connector configured to terminate an end of a coaxial cable, the connector comprising:

a body having a cable receiving end configured to receive the end of the coaxial cable; and a compression ring including a forward sleeve portion and a rearward outer ring portion attached to one another by a plurality of tabs, the forward sleeve portion being configured to be coupled to the cable receiving end of the body, wherein the plurality of tabs are configured to shear so as to separate the rearward outer ring portion from the forward sleeve portion when a torque for rotating the compression ring relative to the body exceeds a desired torque.

4. The connector of claim 3, wherein the outer ring portion includes one or more torque assisting structures.

5. The connector of claim 3, wherein the compression ring is formed of a material selected such that each of the plurality of tabs will shear at a radially inner portion of each of the tabs that connects to the forward sleeve portion when the desired torque is met.

6. The connector of claim 3, wherein each of the tabs includes a strengthening member at its radially outer portion, the strengthening members being configured to facilitate breakage of the tabs at a radially inner portion of each of the tabs that connects to the forward sleeve portion.

7. The connector of claim 3, wherein the body includes at least one stop configured to prevent the compression ring from being overtightened to the body.

8. The connector of claim 3, wherein an outer surface of the forward sleeve portion of the compression ring includes a threaded portion that is configured to be threadedly coupled with a threaded portion of an inner surface of the body.

9. The connector of claim 8, wherein the threaded portions allow for detachable, re-attachable connection of the compression ring to the body.

10. The connector of claim 3, wherein the compression ring is configured to move axially toward a coupler at a forward end of the connector as the compression ring is rotated clockwise relative to the body.

11. The connector of claim 10, wherein the compression ring is configured to move axially from a first position, which loosely retains a coaxial cable within the body, to a more forward second position, which secures the cable within the body, as the compression ring is rotated clockwise relative to the body.

12. The connector of claim 10, wherein the coupler is configured to provide mechanical attachment of the connector to an interface port of an external device.

13. The connector of claim 10, further comprising a resilient sealing O-ring positioned between the body and the coupler at the rotatable juncture thereof to provide a seal thereat.

14. The connector of claim 10, further comprising an outer conductor engager, wherein the body includes a forward portion for coupling with the outer conductor engager, and wherein the outer conductor engager is configured to couple the body with the coupler such that the coupler is rotatably coupled relative to the body and the outer conductor engager.

15. The connector of claim 14, further comprising a sealing gasket disposed at a forward end of the outer conductor engager to provide a weather tight seal between the coupler, the outer conductor engager, and the interface port.

16. A connector configured to terminate an end of a coaxial cable, the connector comprising:

a body configured to receive the end of the coaxial cable; and a compression ring including a forward sleeve portion and a rearward outer ring portion attached to one another by a plurality of tabs, the forward sleeve portion being threadedly coupled to the body, wherein the plurality of tabs are configured to shear so as to separate the rearward outer ring portion from the forward sleeve portion when the compression ring is rotated relative to the body at a torque that exceeds a desired torque.

17. The connector of claim 16, wherein the body includes at least one stop configured to limit axial movement of the compression ring relative to the body when the compression ring is rotated relative to the body.

18. The connector of claim 16, wherein an outer surface of the forward sleeve portion of the compression ring includes a threaded portion that is configured to be threadedly coupled with an inner surface of the body.

19. The connector of claim 16, wherein the compression ring is configured to move axially toward a coupler at a forward end of the connector as the compression ring is rotated relative to the body, and wherein the body includes at least one stop configured to limit axial movement of the compression ring relative to the body when the compression ring is rotated relative to the body.

20. The connector of claim 16, wherein the compression ring is configured to move axially from a first position, which loosely retains a coaxial cable within the body, to a second position, which secures the cable within the body, as the compression ring is rotated clockwise relative to the body.

21. The connector of claim 16, further comprising an outer conductor engager, wherein the body includes a forward portion for coupling with the outer conductor engager, and wherein the outer conductor engager is configured to couple the body with the coupler such that the coupler is rotatably coupled relative to the body and the outer conductor engager.

* * * * *